United States Patent [19]

Murphy

[11] 4,280,635

[45] Jul. 28, 1981

[54] VASE COVER

[76] Inventor: Richard W. Murphy, 17846 San Clemente St., Fountain Valley, Calif. 92708

[21] Appl. No.: 64,118

[22] Filed: Sep. 27, 1979

Related U.S. Application Data

[63] Continuation-in-part of Ser. No. 928,723, Jul. 27, 1978, abandoned.

[51] Int. Cl.[3] ..... B65D 43/10

[52] U.S. Cl. ..... 220/306; 220/356; 206/508

[58] Field of Search ..... 220/306, 352, 356, 74, 220/354; 215/317, 321; 206/508; 229/43

[56] References Cited

U.S. PATENT DOCUMENTS

| | | | |
|---|---|---|---|
| 3,583,596 | 6/1971 | Brewer | 220/306 |
| 3,805,994 | 4/1974 | Cherry et al. | 220/306 |
| 3,883,036 | 5/1975 | Mahaffy et al. | 220/306 |
| 4,004,710 | 1/1977 | Crisci | 220/356 X |
| 4,014,459 | 3/1977 | Robinson | 220/356 X |
| 4,079,857 | 3/1978 | Crisci | 220/306 |

*Primary Examiner*—Steven M. Pollard

[57] ABSTRACT

A thermo plastic cover for a vase with a flat recessed circular top and a raised flat surface surrounding the periphery with a sloped edge formed circumferencially and an edge continuing at 90° to the flat top. A circular series of sloped flanges on the underside surface interface with the lip of a floral vase forming a cover that snaps into place providing a lid to convert the vase to an attractive display stand or stool.

2 Claims, 7 Drawing Figures

VASE COVER

This application is a continuation in part of the Inventor's prior application Ser. No. 928,723 filed July 27, 1978 now abandoned.

BACKGROUND OF THE INVENTION

1. Field of the Invention

This invention relates to covers for recepticles in general and more specifically to water containing type with end structures and supports. It converts these containers to display stands or stools.

2. Description of the Prior Art

Previously, vases and pots use were primarily for storing plants, either cut or growing, consists of an enclosure with one open portion. The shape has varied, being square, rectangular, irregular, etc., however, round has predominated. These vases are made of an entire range of different known materials. Within comparatively recent years there has been a move toward the use of thermoplastic materials in order to reduce the cost. This material has proven satisfactory as it is inert and if used in sufficient thickness has the structural integrity necessary for this application. The use of covers or lids for this type of vase have not been utilized to any great extent as conventional shapes do not lend themselves to this appendage. The use of a cover or lid to convert these pots to another use is unknown in the prior art. The pot construction disclosed in U.S. Pat. No. 3,371,819, Zeman, Mar. 5, 1968, is greatly enhanced by the use of a cover and is well adapted to receive this cover on either end. As prior are for containers for flowers, do not normally include an affixed cover, nor are other uses described for said containers, there is still areas of significant improvement and the present invention is directed to this end.

SUMMARY OF THE INVENTION

This invention pertains to a cover for vases or pots used in floral display and storage. In particular, the cover is adapted to be utilized in pot constructions such as taught by U.S. Pat. No. 3,371,819, Zeman, Mar. 5, 1968. This type of pot provides a circular lip at the open end and is smooth and has an angular displacement convenient to recieve an attachment. This type of vase in conjunction with its open end further contains a base of similar construction in the shape of a frustum of a cone that is attached by having the pot inserted into the base so as to be supported thereby. This base is snapped into place at the top interfacing with the vase by a protruding ridge or ridges locking the two parts together forming a base to support the pot member. This base has a bottom lip of similar construction to the pot top that may receive a cover equally well.

Accordingly it is the primary object of the invention to provide a vase cover for storage that is easily removed but withstands handling and accidental detachment. This allows further utility to the vase providing substances requiring a cover to be easily and safely stored in an enclosed environment.

An important object allows the vase with the cover attached to the base to become a stand for home or commercial display of flowers and plants. The cover increases the surface area in contact with the floor, or object on which it rests, and greatly improves its stability. This added surface makes the complete base not easily tipped when accidentally struck or bumped.

Another object allows the complete pot assembly with the cover on the top to be utilized as a seat on which one may sit easily as the structural integrity of such a combination would readily permit such utility.

Still another object provides a stand for a clay type potted plant to be inserted into the base only, with the cover attached on the bottom.

This application provides a bottom container to catch and hold water allowing the plants to be watered without the residual water going through the plant and thereby damaging the floor or surface under the pot.

Yet another object yields further utility by converting the vase and base with covers on both ends into a stool capable of withstanding a persons weight either standing or sitting. The surface area being large enough to be stable and comfortable for seating purposes.

A further object provides convenient storage of a plurality of covers as they are easily stacked together and are readily removed from the vases.

Still another object increases the decorative value of the assembly as a series of raised bosses surround the periphery of the cover to add decor to the shape of the object.

These and other objects and advantages of the present invention will become apparent from the subsequent detailed description and the appended claims taken in conjunction with the accompanying drawings.

DESCRIPTION OF THE PREFERRED EMBODIMENT

Figure 1:
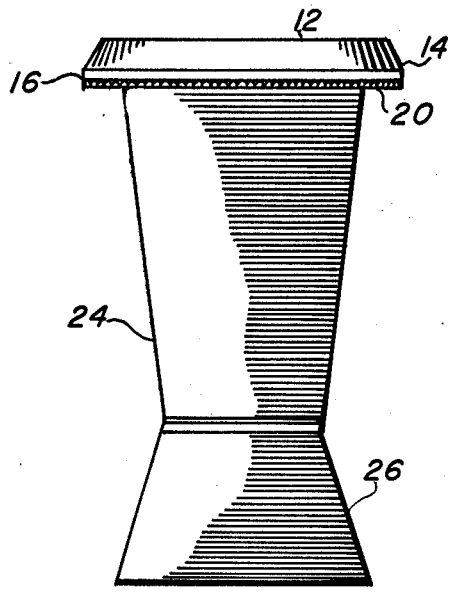
FIG. 1 is a side view of the cover attached to the top of the pot and the pot base.
Figure 3:
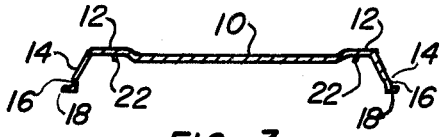
FIG. 3 is a cross-sectional view of the cover through the major diameter.
Figure 2:
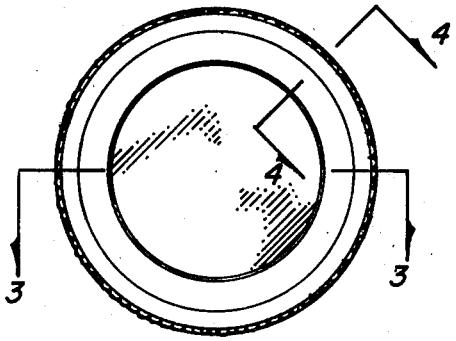
FIG. 2 is a top plan view of the cover.
Figure 4:
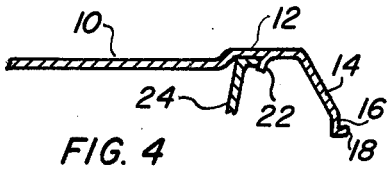
FIG. 4 is a partial sectional view of the cover attached to a vase or pot.
Figure 6:
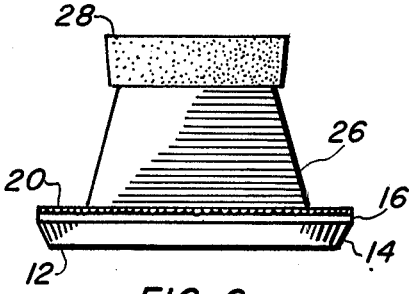
FIG. 6 is a side view of the cover attached to the bottom of the base with a clay pot inserted inside.
Figure 5:
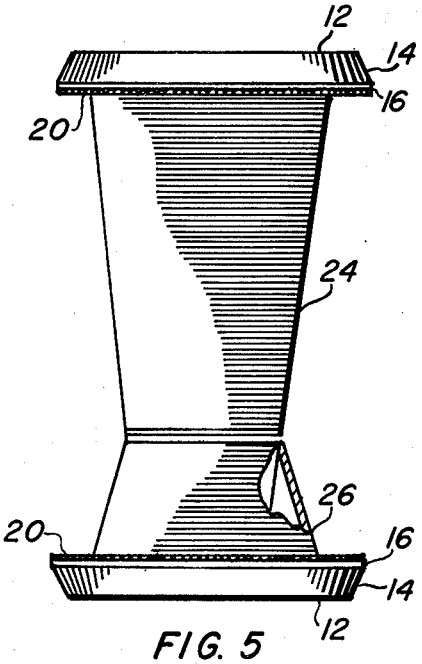
FIG. 5 is a side view of covers attached to the top of a pot and the bottom of the base.
Figure 7:
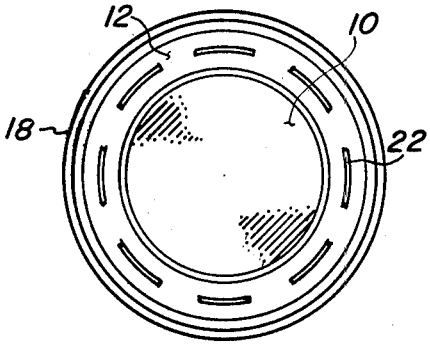
FIG. 7 is a bottom plan view of the cover.

Referring now in detail to the drawings and describing the preferred embodiment, the invention consists of a flat recessed surface 10 being circular in shape of a thickness to provide sufficient structurally integrity to support the weight of a person seated thereon. This surface is smooth and has a flat recessed surface 12 ajoining the periphery forming a round flat top of the cover. The recess in the cover reduces the chances of a potted plant, when on display, from easily sliding off the stand. This surface is raised approximately the thickness of the prime material from the flat surface 10 and is formed on a 45° angle. The top structure is continued with sloped edges 14 from the raised surface 12 at an angle from 15° to 45° with 30° being preferred. This edge 14 slopes away from the flat surface 12 and is radiused at the interface approximately a material thickness to provide a pleasing transition from flat to angular. A circumferential edge 16 at 90≦ to the flat raised surface 12 ajoins the sloped edge 14 and contains a circular projection 18 on the outside surface creating a blub shaped termination to the cover. A plurality of radiused projections 20 surround the circumferential edge to form a design effect enhancing and increasing the rigidity at the extremity of the structure. The underside of the cover further contains a plurality of flanges 22 arranged in a circle with the outside of the flange members at a 30° right angle away from the circumferential edge 16. The apex of the flange members being sloped 15° from vertical as viewed from the cross-section depicted in FIG. 4. The inward surface of the flanges being at right angles to the flat raised surface 12 with a 15° raised terminus joining the anngular apex of the flat edge. These flanges 22 are adapted to be attached to the outside lip of a pot structure 24 and mating base 26 such as disclosed in U.S. Pat. No. 3,371,819, Zeman, Mar. 5, 1968. This pot construction is formed of material capable of being deformed as to the application force and then returning to the initial configuration upon release of such force. The cover is also flexible in construction to allow the flanges 22 to interface with the pot lip snapping into place with applied force and detachable by the reverse procedure. The fit and tolerance of the parts allow this attachment and detachment to be repeated without permanent deformation of either part. When the cover is assembled to the pot 24 or base 26, sufficient friction allows the cover to stay in place under conditions of uneven weight loading and physical abuse. The cover fits both the pot 24 and the mating base 26 equally well and is used separately on either structure or together as a lid or a stool seat. There is no waterproof seal so moisture may evaporate from within the container. The invention is fabricated of suitable materials that possess the necessary properties of strength, rigidity and flexibility such as common grades of thermoplastic materials including polystryenes and polyethylenes with polypropolyenes being preferred. FIG. 1 depicts the cover attached to the pot 24 and base 26 with the utility of an enclosed storage container. FIG. 5 discloses two covers attached to the pot 24 and the base 26 becoming a stool upon which to sit or stand with the area sufficient to provide stability and a seat surface of comfortable configuration. The use of base 26 with the cover attached to the bottom best shown in FIG. 6 allows the combination to be utilized in conjunction with a clay type pot 28. This provides a waterproof base and a decorative cover for the pot 28 and increases the stability of the assembly. FIG. 7 is a bottom plan view showing the circular arrangement of the flanges 22 which interact with the top edge of the pot 24.

While the invention has been described in complete detail and pictorily shown in the accompanying drawings it is not to be limited to such details since many changes and modifications may be in the invention without departing from the spirit and scope thereof hence it is described to cover any and all modifications and forms which may come within the language and scope of the appended claims.

I claim:

1. A cover for a vase comprising:

a flat recessed surface;

a flat raised surface ajoining the periphery of said recessed surface;

sloped edges from said raised surface 15° to 45°;

a circumferential edge 90° to said flat top surface and adjoining said sloped edge; and a plurality of angular flanges arranged in a circle on the underside of said flat raised surface that interface with a lip bulb on a vase snapping into place and firmly attaching said lip to said vase.

2. The invention according to claim 1 in which said circumferential edge contains a plurality of radiused projections in geometrical configuration.

* * * * *